US011660610B2

(12) United States Patent
Birk et al.

(10) Patent No.: US 11,660,610 B2
(45) **Date of Patent: *May 30, 2023**

(54) TURBINE AND LIQUID SEPARATOR HAVING SUCH A TURBINE

(71) Applicant: GRIMALDI DEVELOPMENT AB, Nacka Strand (SE)

(72) Inventors: Maximilian Birk, Neu-Ulm (DE); Christoph Erdmann, Ulm (DE); Petr Polednak, Neu-Ulm (DE); Francesco Zitarosa, Illertissen (DE)

(73) Assignee: GRIMALDI DEVELOPMENT AB, Nacka Strand (SE)

( * ) Notice: Subject to any disclaimer, the term of this patent is extended or adjusted under 35 U.S.C. 154(b) by 649 days.

This patent is subject to a terminal disclaimer.

(21) Appl. No.: 16/337,472

(22) PCT Filed: Sep. 28, 2017

(86) PCT No.: PCT/EP2017/074584

§ 371 (c)(1),
(2) Date: Mar. 28, 2019

(87) PCT Pub. No.: WO2018/060306

PCT Pub. Date: Apr. 5, 2018

(65) Prior Publication Data

US 2019/0224690 A1 Jul. 25, 2019

(30) Foreign Application Priority Data

Sep. 28, 2016 (DE) ..... 20 2016 105 409.5

(51) Int. Cl.
*B04B 5/00* (2006.01)
*B04B 5/12* (2006.01)
(Continued)

(52) U.S. Cl.
CPC ..... *B04B 5/005* (2013.01); *B04B 5/12* (2013.01); *B04B 7/14* (2013.01); *B04B 9/06* (2013.01);
(Continued)

(58) Field of Classification Search
CPC .. B04B 5/005; B04B 5/12; B04B 9/06; B04B 7/14; F01M 13/04; F01M 2013/0422
(Continued)

(56) References Cited

U.S. PATENT DOCUMENTS 2,497,041 A * 2/1950 Bodger ..... F01D 9/044 415/177
4,768,344 A 9/1988 Stojicic
(Continued)

FOREIGN PATENT DOCUMENTS

DE 202007008081 U1 10/2008
DE 202007009913 U1 11/2008
(Continued)

OTHER PUBLICATIONS

European Patent Office, International Search Report with Written Opinion, issued in PCT/EP2017/074584, dated Nov. 21, 2017, 12 pages, European Patent Office, Rijswijk, Netherlands.
(Continued)

*Primary Examiner* — Shuyi S. Liu

(57) ABSTRACT

A turbine having a turbine wheel, as used for example as a drive for active oil separators, and to a liquid separator having such a turbine is described.

17 Claims, 9 Drawing Sheets

(51) Int. Cl.
*F01M 13/04* (2006.01)
*B04B 9/06* (2006.01)
*B04B 7/14* (2006.01)

(52) U.S. Cl.
CPC ..... *F01M 13/04* (2013.01); *F01M 2013/0422* (2013.01)

(58) Field of Classification Search
USPC ..... 123/196 A, 196 R; 55/385.1, 400
See application file for complete search history.

(56) References Cited

U.S. PATENT DOCUMENTS

| | | | | |
|---|---|---|---|---|
| 5,507,622 | A * | 4/1996 | Avny | F16H 41/28 416/244 R |
| 6,668,539 | B2 | 12/2003 | Schlote | |
| 6,996,971 | B2 | 2/2006 | Schlote | |
| 8,714,132 | B2 | 5/2014 | Baumann et al. | |
| 9,255,478 | B2 | 2/2016 | Purdum et al. | |
| 2010/0180854 | A1* | 7/2010 | Baumann | B04B 5/005 123/196 R |
| 2020/0238294 | A1* | 7/2020 | Araos Almendras | A23L 2/39 |

FOREIGN PATENT DOCUMENTS

| | | | |
|---|---|---|---|
| EP | 1782888 | A1 | 5/2007 |
| FR | 2594483 | B1 | 4/1994 |

OTHER PUBLICATIONS

Cover page of the earliest claimed German priority document with German Search Report citations and a detailed citation list.

* cited by examiner (A-A)

(B-B)

TURBINE AND LIQUID SEPARATOR HAVING SUCH A TURBINE

BACKGROUND

The present invention relates to a turbine comprising a turbine wheel, as used for example as a drive for active oil separators, and to a liquid separator comprising such a turbine.

In such active oil separators, use is often made of a separating element which is set in rotation in order to ensure a sufficient degree of separation of a liquid out of a gas, for example of oil mist or oil droplets out of blow-by gases of an internal combustion engine.

Such turbines comprise a turbine wheel which is driven by a fluidic drive medium. In the case of oil separators in ventilation systems of internal combustion engines, particularly in the case of vehicles, often the oil pressure of the engine oil is used to drive the turbine wheel. In the case of stationary oil separators, however, a hydraulic drive can also be used.

Such a turbine wheel is coupled to a shaft or is mounted centrally on a shaft and drives said shaft, the latter in turn being coupled to a rotatable separating element. In active oil separators which are customary in the prior art, in which a turbine wheel is driven by means of the oil pressure, the drive fluid is conducted through a central bore in the shaft to the turbine wheel and is introduced into the turbine wheel at that point. The turbine wheel has a nozzle on its edge, which nozzle is directed approximately in a tangential direction and through which the fluidic drive medium is discharged. The turbine wheel is set in rotation as a result. Speeds of up to 20,000 rpm are typical.

The term "turbine wheel" is not restricted to an approximately circular element, but rather also encompasses other shapes of bodies capable of rotation.

Such turbine wheels in the prior art are usually manufactured from stainless steel. This makes the turbine wheel heavy and in particular difficult and expensive to manufacture.

SUMMARY

The object of the present invention is therefore to provide a turbine wheel and a liquid separator which can be manufactured inexpensively, with a stable outer contour and with precision, and which have a low weight. In particular, the aim is to reduce the complexity of manufacture, to increase the integration potential and to simplify installation of the turbine according to the invention. The aim is also to provide a liquid separator which comprises such a turbine according to the invention.

According to the invention, the turbine comprises a turbine wheel which has a first channel running along the axis of rotation of the turbine wheel. This first channel can either serve as a central receptacle for a shaft, so that the shaft can be fastened to the turbine wheel, or can run in the extension of the receptacle for such a shaft. By way of example, the turbine may be injection-moulded onto a shaft, which is usually at least partially made of steel. In another variant, it is also possible to provide the turbine with a receiving geometry for a metal shaft. It is also possible to embed the shaft in the turbine wheel, for example by hot embedding. In addition, a bearing for the shaft may also be provided in this region.

The turbine wheel according to the invention additionally has a second channel, running substantially in a radial direction, for guiding the fluidic drive medium, for example engine oil, said second channel having an inlet and an outlet for the fluidic drive medium. The inlet is fluidically connected to the first channel. The outlet is directed substantially in a tangential direction of the turbine wheel. In individual cases, however, it may be advantageous if the direction of discharge is at an angle of 85 to 95° to the direction of the first channel, that is to say has a small vector component in the axial direction of the shaft. This applies in particular in the case of very high speeds.

The use of metal or ceramic insertion elements makes it possible at least for the components to be highly precise and extremely dimensionally stable at the critical points.

It is particularly advantageous if the turbine wheel according to the invention has exactly one second channel, since all the drive fluid is thus available at the outlet of said one second channel.

The turbine according to the invention additionally has a fluid nozzle in the outlet. Instead of one single fluid nozzle, however, it is also possible for a plurality of fluid nozzles to be arranged next to one another, all of these having substantially the same discharge direction. Regardless of the exact number of nozzles, a fluid guidance is obtained which is symmetrical with regard to a cross-section through the central plane of the turbine but is otherwise unsymmetrical.

In addition, a metal and/or ceramic reinforcement is arranged in at least one section of a wall of the first and/or second channel.

This turbine according to the invention, comprising the turbine wheel according to the invention, exhibits a simple and inexpensive design. Since all that is required is to manufacture the turbine wheel with its two channels and integrate the metal reinforcement, the number of individual parts required in order to manufacture the turbine wheel is very low. Since the turbine wheel can in particular either be shrunk onto the shaft, injection-moulded directly onto the shaft, or the shaft can be embedded in the turbine wheel, depending on whether the first channel does or does not have a metal reinforcement, the installation time is shortened and thus the installation costs are also reduced.

The inlet of the second channel may be provided, for example, adjacent to the shaft in the passage of the shaft through the turbine wheel, so that the drive fluid is conducted through a central bore of the shaft to the passage region and from there can be introduced into the turbine wheel via a lateral bore in the shaft and the inlet according to the invention.

The second channel is preferably curved or angled.

The outlet is preferably arranged on the circumferential edge of the turbine wheel. The fluid nozzle arranged in the outlet may be formed in one piece with the second channel, so that the turbine wheel contains the fluid nozzle as an integral component. Alternatively, the fluid nozzle may be inserted, for example screwed, embedded or injection-moulded, into the second channel as a separate component in the region of the outlet and may contain or be made of a metal and/or a ceramic. It is also possible to configure this fluid nozzle as an insert, which is fastened in the outlet. To this end, said fluid nozzle can be inserted in the outlet and secured by a securing means. Suitable securing means are, for example, blades or slides which are inserted transversely to the longitudinal direction of the channel. To facilitate the insertion of the fluid nozzle, the outlet may be conical. In particular, the fluid nozzle may be arranged in the outlet in such a way that a direction of discharge of the fluidic drive medium from the fluid nozzle runs substantially perpendicular to the first and/or second channel. The fluid nozzle may contain or be made of a metal, a ceramic or a high-grade plastic.

In particular, in a first variant, only the one-piece turbine wheel and a suitable, for example metal or ceramic, fluid nozzle are required.

In one advantageous exemplary embodiment of the present invention, the entire wall of the first channel and/or of the second channel may have a metal reinforcement. In particular, the metal reinforcement forms the inner wall of at least one channel or of the nozzle. This enables particularly easy manufacture. In addition, less abrasion occurs on a metal inner wall than on a plastic inner wall.

It is particularly preferred if the metal reinforcement of the first and/or second channel is configured as a metal tube, which is at least partially surrounded by plastic, in particular overmoulded with plastic.

It is also advantageous if the metal reinforcement or the metal tube in the first channel has, in a region of connection to the second channel, a cutout in which the metal reinforcement or the metal tube for the second channel is inserted and/or in which the metal reinforcement or the metal tube for the second channel is welded, soldered or crimped to the metal reinforcement or the metal tube in the first channel, in particular in a media-tight manner. The metal reinforcements or the metal tubes for the first and second channel may also already be welded, soldered or crimped to one another, or inserted in one another optionally with the aid of O-rings or similar sealing elements, in a media-tight manner prior to manufacture of the turbine wheel. The turbine wheel can then subsequently be injection-moulded onto the joined metal reinforcements or metal tubes. Alternatively, the metal reinforcements or metal tubes may also first be simply suitably oriented and fixed relative to one another and then jointly embedded in the material of the turbine wheel, such as plastic for example.

In a further advantageous exemplary embodiment of the invention, the first and second channel, with the exception of the outlet, may extend substantially rectilinearly. This is particularly advantageous when manufacturing the turbine wheel in an injection moulding, injection-compression moulding and/or pressing process.

Many additional functions can easily be integrated in the turbine wheel according to the invention. By way of example, it is possible to provide, on the top side of the turbine wheel, a connection piece which partially holds the shaft so that an improved securing of the shaft in the turbine wheel is achieved. Said connection piece may be manufactured in one piece with the turbine wheel, in particular may be injection-moulded in one piece therewith.

It is also possible to provide, on the top side and/or bottom side of the turbine wheel, a connection piece which enables mounting of the rotating components or which at least partially holds and/or guides the shaft. It is particularly advantageous if a partition wall, in particular a partition wall which is manufactured integrally with the turbine, is provided between the shaft and the first channel of the turbine so that no drive oil can reach the shaft. If such a partition wall is provided, the first channel is then in particular not designed to receive the shaft but rather runs in the extension of the shaft. The drive oil is fed through a conduit section in the connection piece to the first channel and onward to the second channel.

In particular, it is advantageous that the turbine wheel can be made in a lightweight construction. To this end, the turbine wheel and/or the housing thereof may for example be largely or entirely made of plastic. Suitable thermoplastics with particular advantage are polyphenylene sulphide (PPS), polyetherimide (PEI), polyimide (PI), polyphthalamide (PPA), polyether ether ketone (PEEK), polyamide (PA), polypropylene (PP), polyamide-imide (PAI), polysulphone (PSU) and/or liquid crystal polymer (LCP), or combinations of the aforementioned materials. They may additionally be reinforced by means of fibres, such as aramid fibres, carbon fibres or glass fibres, and/or other fillers, for example particulate fillers, such as glass beads or mineral-based particles. Suitable fillers are, in particular, calcium carbonate, calcium sulphate, kaolin, mica, talc, and quartz. Use can also be made of thermosetting plastics, such as polyester resins (UP), vinyl ester resins (VE), epoxy resins (EP), phenol resins (PF), and melamine-formaldehyde resins (MF). Such a turbine wheel can be manufactured particularly easily, for example by injection moulding, injection-compression moulding, or pressing. If the turbine wheel is made of a thermosetting material, this can also be achieved by transfer moulding. Manufacturing from metals, preferably lightweight metals, for example aluminium, is also possible. To this end, for example, sinter material can be processed by means of 3D printing.

To enable a simple design of the mould, it is advisable to provide the second channel in such a way that it extends from one circumferential edge to the other circumferential edge of the turbine wheel and thus has two opposite openings on the circumferential edge of the turbine wheel. The opening on one side of the channel, which is not required for fluid guidance, can then be closed by a closure means. Suitable closure means are, for example, stoppers which are pressed into the opening and which can be secured by a blade or a slide. It is advantageous if the blade or the slide is inserted from or through the top side or bottom side of the turbine and is guided at least partially in a groove laterally and/or in the wall opposite the insertion side. Such a blade or such a slide may also be part of another component adjacent to the turbine, or may be configured as an integral extension thereof. A welding of the stopper is also possible; this may optionally be combined with other welding operations for manufacturing the turbine. A screw closure, a bayonet-type closure or a ball inserted with a press fit may also be used to close an opening of the channel. Said closure should advantageously be fluid-tight, so that a closed fluid path is provided from the inlet to the outlet. To this end, the closure means may be combined with a suitable sealing means, for example with an O-ring or a fluid sealing means.

If the turbine wheel is made of plastic, various advantageous embodiments of the turbine wheel can be implemented.

For example, the turbine wheel may be formed of multiple parts, in particular of two half-shells. The half-shells or part-shells may be either two halves of the turbine wheel over in each case 180° of the circumferential edge of the turbine wheel, or else the top side and the bottom side of a turbine wheel. By no means do the two half-shells have to be manufactured identically or as a mirror image of one another. They may also be part-shells which account for different proportions by weight and/or by volume of the turbine wheel as a whole; there may therefore optionally be just one part-shell, wherein it is advantageous if only two part-shells are joined to form a turbine wheel. In the extreme case, one half-shell is merely a flat cover which closes an opening in the other half-shell. A seal, for example a moulded rubber seal and/or an O-ring, may advantageously be arranged between the individual parts, in particular between the two half-shells of the turbine wheel. Said seal is compressed between the two parts, for example by screwing, welding or clipping the two half-shells together or by joining them to one another in some other way, for example in a manner analogous to a bayonet-type closure.

The turbine wheel may additionally have a housing, within which inter alia the channels (or the walls thereof) and further reinforcing structures, for example reinforcing webs or stiffening ribs, may be arranged. The housing may be formed in one piece with the turbine wheel. It is also possible to omit the housing and to manufacture the turbine wheel exclusively from the walls of the channels and optionally such reinforcing structures. The outer walls of the channels, the reinforcing structures and the housing all serve inter alia also to reinforce the turbine wheel, to establish the correct weight distribution (balancing the turbine wheel), and also to guide the oil for example. The housing, the reinforcing structures and the channels or the walls thereof can therefore be configured differently in terms of their orientation, thickness and shape and the like, depending on the design. In particular, the configuration of the reinforcing webs or stiffening ribs may serve design purposes with regard to noise, vibration and heat distribution (NVH, Noise Vibration Harshness optimization). In addition, a rib structure encourages oil, particularly splashed oil, to agglomerate and run off.

However, the housing may also be formed as a half-shell, for example as a bottom or top (lower part and upper part) of the turbine wheel. The housing may in this case advantageously have a smooth and/or closed surface. It is also possible to apply functional components to a surface of the turbine wheel, for example an impeller for generating a vacuum and/or a sealing element.

Particularly when using a turbine wheel made of plastic or substantially made of plastic, further functional elements, such as a magnet for example, may be embedded in the turbine wheel. By means of such an embedded magnet, it is possible for example to detect the rotational speed of the turbine wheel. In addition, a sliding bearing may be cast into the turbine wheel so that the turbine wheel can be mounted, together with or separately from the shaft, with little friction in an oil separator. The use of plastic also makes it possible to injection-mould the turbine wheel directly onto the shaft, for example to injection-mould it in a media-tight manner onto a steel shaft. A sealing by means of additional sealing elements, such as O-rings for example, is possible in addition or as an alternative.

Some examples of turbines according to the invention and of liquid separators according to the invention will be given below. The following examples include, besides the features necessary according to claim 1, a large number of optional developments which may serve individually, or in any combination, and also in combination with one or more optional features of other examples, to develop the turbine according to the invention and the liquid separator according to the invention.

BRIEF DESCRIPTION OF THE DRAWINGS

Hereinbelow, identical or similar reference signs will be used for identical or similar components in the individual examples, and therefore the description of said reference signs will not always be repeated. In the figures.

DETAILED DESCRIPTION

Figure 1:
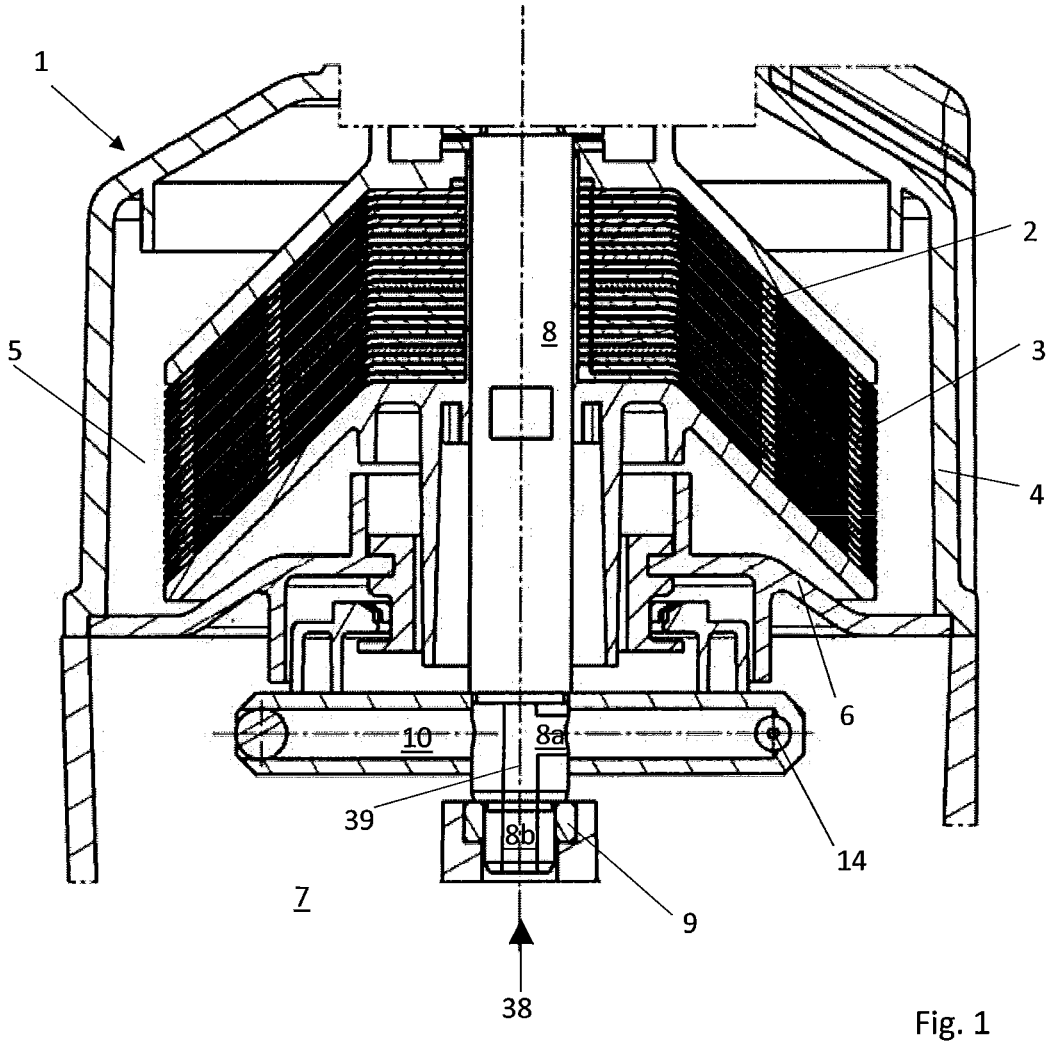
FIG. 1 shows a vertical section through a liquid separator according to the invention.

FIG. 1 shows a vertical section through a liquid separator 1 according to the invention. The liquid separator 1 has a housing 4, which is divided into a drive chamber 7 and a separation chamber 5. The drive chamber 7 and the separation chamber 5 are separated from one another by a partition wall 6. A disc separator 2 is arranged in the separation chamber 5, said disc separator having a plurality of discs 3 stacked one above the other as separating elements. The disc separator 2 is fastened, in the axis of rotation thereof, to a shaft 8. The shaft 8 extends into the drive chamber 7 through an opening in the partition wall 6. In the drive chamber 7, the shaft 8 is rotatably mounted on a bearing 9. In the drive chamber 7, a turbine 10 is also fastened to the shaft 8. The turbine 10 drives the disc separator 2 by means of a drive fluid, such as engine oil for example. When the liquid separator 1 is operated as an oil separator in an internal combustion engine, engine oil flows as the drive fluid through a central bore 8*b* in the interior of the shaft 8. The arrow 38 indicates the direction in which the engine oil is supplied. In the region of the turbine 10, the engine oil passes from the shaft 8 into the turbine 10 via a lateral bore 8*a* in the shaft 8, is conducted to the circumferential edge of the turbine 10 due to the rotation of the turbine wheel, and is discharged again through a fluid nozzle 14 which is directed approximately in a tangential direction. The turbine wheel is set in rotation as a result, and the disc separator 2 fixedly connected to the turbine 10 via the shaft 8 is thereby driven.

Figure 2:
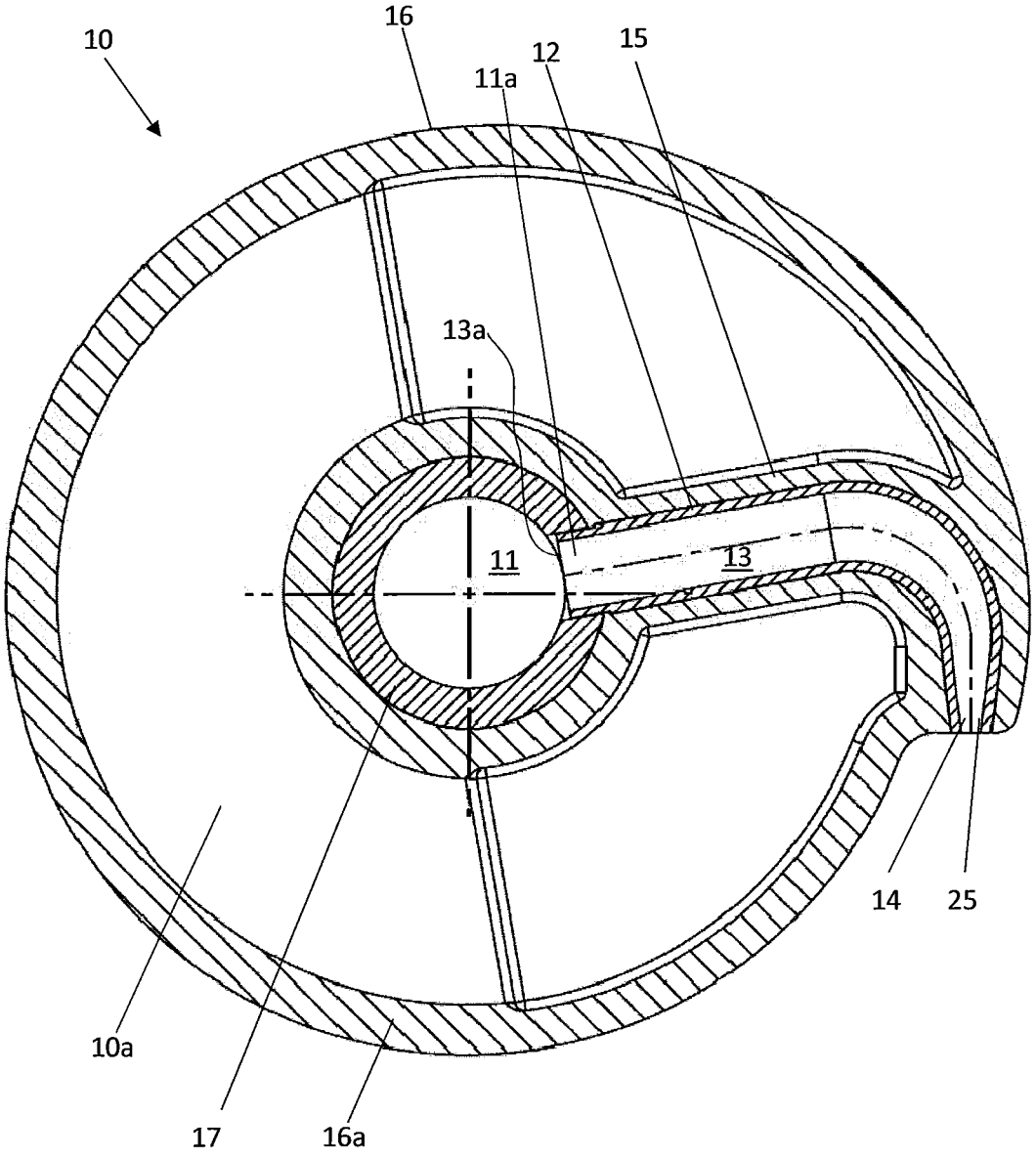
FIG. 2 shows a horizontal section through a first exemplary embodiment of a turbine according to the invention.

FIG. 2 shows a horizontal section through a turbine 10 according to a first exemplary embodiment. The turbine 10 has an approximately rotationally symmetrical turbine wheel 10*a*, which has along its central axis a first channel 11 for receiving a shaft. Leading away from the first channel 11 in an approximately radial direction is a second channel 13 for guiding the drive fluid to the circumferential edge of the turbine wheel 10*a*. The second channel 13 has an inlet 13*a* at the first channel 11 and an outlet 25 on the circumferential edge of the turbine wheel 10*a*. In the region of the circumferential edge, the second channel 13 has an approximately right-angled bend, so that the outlet is directed approximately in a tangential direction. The turbine has a plastic casing 15 along the circumferential edge and also along the walls of the first and second channel 11 and 13. Furthermore, within the first channel 11, a metal reinforcement 17 is arranged in the plastic casing 15, on the channel side thereof, said metal reinforcement being directly adjacent to the plastic casing 15. A metal tube 12 is arranged inside the entire second channel 13, including the fluid nozzle 14, on the surface of the plastic casing 15. In the region of the inlet 13*a* of the second channel 13, the metal reinforcement 17 has a cutout 11*a*, into which the metal tube 12 is introduced. The metal tube 12 tapers conically towards the outlet 25 and thus forms a fluid nozzle 14, which is thus formed in the turbine wheel 10*a* in one piece with the turbine wheel 10*a*.

Figure 3A:
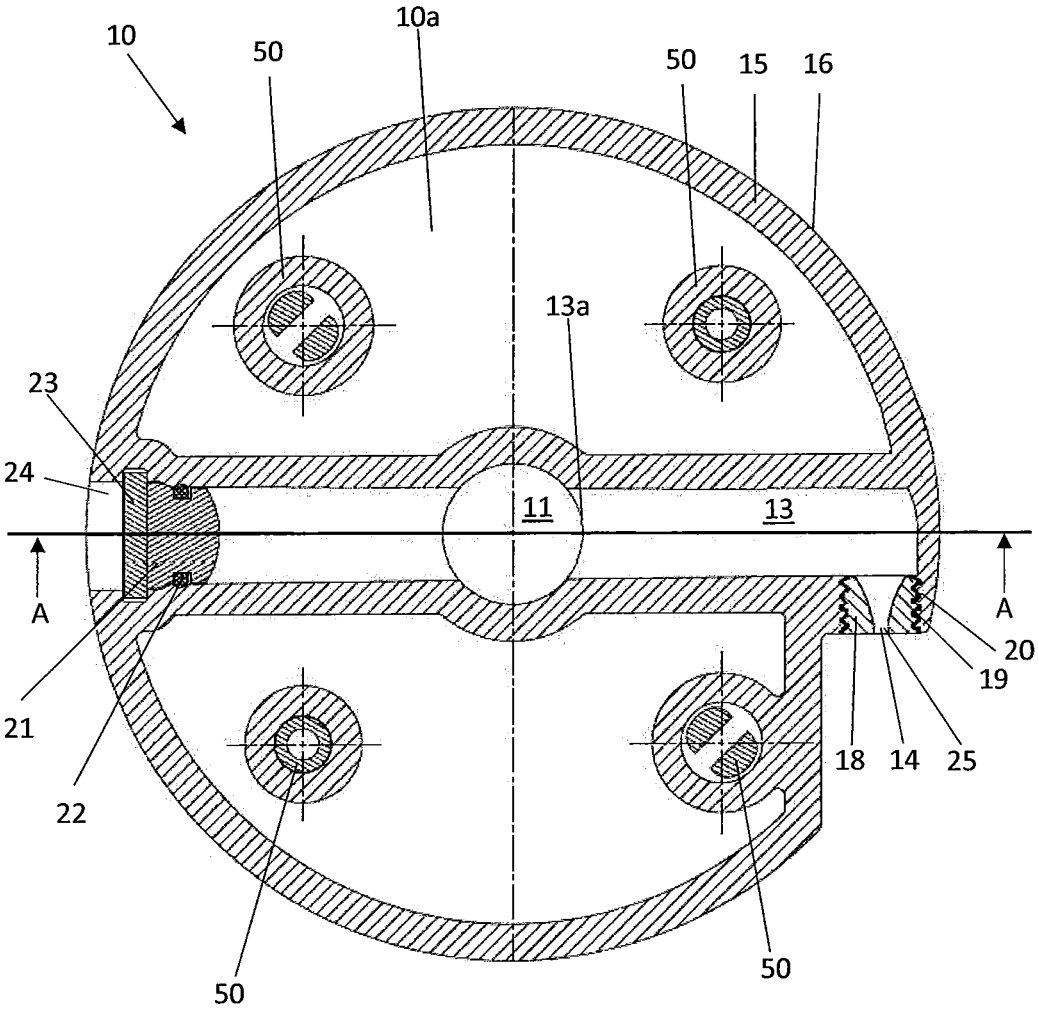
FIG. 3A shows a horizontal section through a second exemplary embodiment of a turbine according to the invention, from a top side.
Figure 3B:
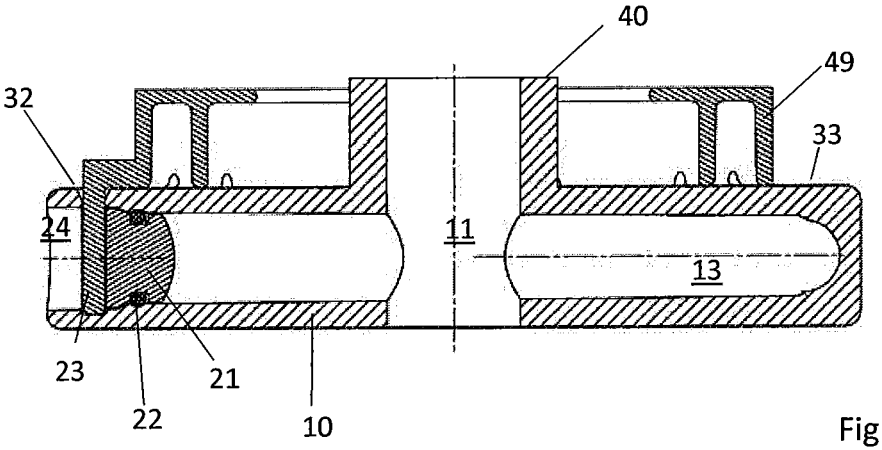
FIG. 3B shows a vertical section through the second exemplary embodiment.
Figure 3C:
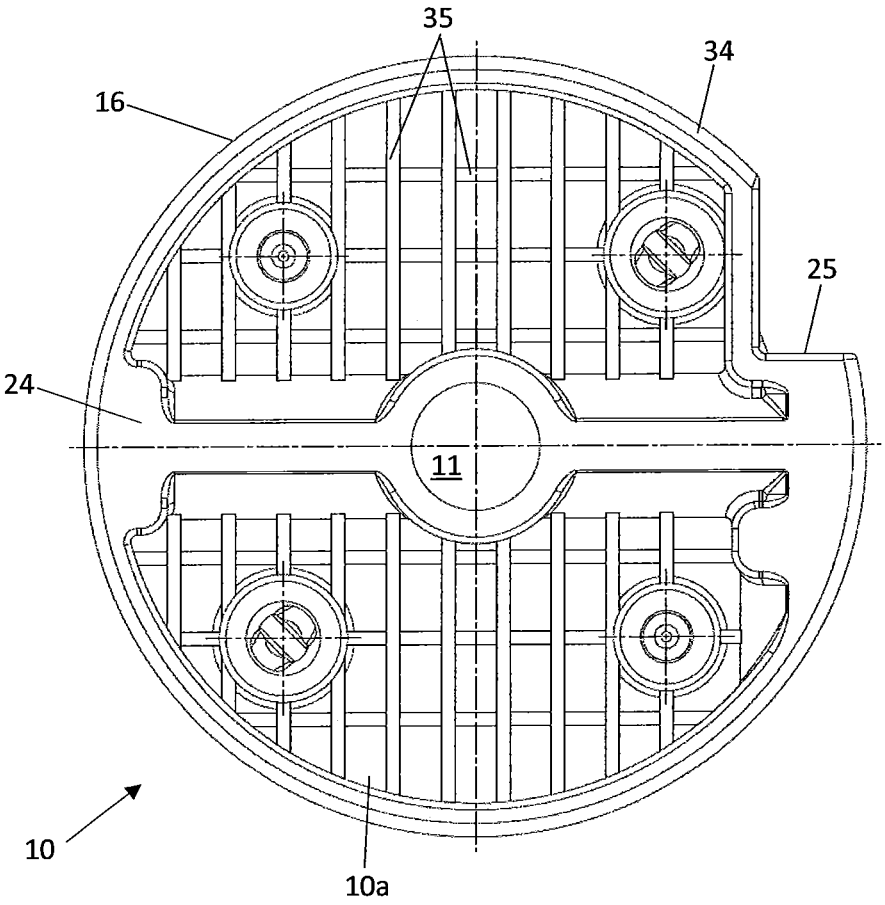
FIG. 3C shows a view of the turbine according to the second exemplary embodiment, from a bottom side.

FIGS. 3A, 3B and 3C show a second exemplary embodiment of a turbine 10 according to the invention. FIG. 3A shows a horizontal section through the turbine 10. In this exemplary embodiment, the second channel 13 has two openings 24 and 25 on the circumferential edge 16, said openings being arranged approximately diametrically and pointing in different directions. The second opening 24 is formed by the manufacturing process, since the second channel 13 has been formed by a channel-forming tool which has been pulled back out through the second opening 24 once the turbine wheel 10*a* has been formed. The second opening 24 is closed by a stopper 21 as a closure element with a seal 22 and by a slide 23 as a securing element for the stopper 21, which prevents the stopper 21 from being pushed out. The slide 23 engages through the upper wall of the channel 13 into a small slot-like widening of the second channel 13. By means of the closure element 21, the second channel 13 is closed in a fluid-tight manner at the second opening 24. The outlet 25 of the second channel 13 is arranged as a first opening approximately diametrically opposite thereto, this being angled approximately in a tangential direction. In the outlet 25, a metal threaded component 18 having a fluid nozzle 14 is screwed into the turbine wheel 10*a*. The external thread 19 of the fluid nozzle 14 is formed in the metal of the threaded component 18. The internal thread 20 may be formed directly in the plastic casing 15 or may form as the external thread 19 of the fluid nozzle 14 is being screwed in. Centring and fastening devices 50 for fastening an impeller 49 are arranged on the top side of the turbine.

FIG. 3B shows a view of the turbine of FIG. 3A along the line A-A. An impeller 49 is arranged on the top side of the turbine, for example in order to generate a vacuum and/or as an element of the sealing system. Here, the slide 23 is formed in one piece with the impeller 49. The impeller 49 is fastened to the centring and fastening devices 50. A connection piece 40 is also arranged on the top side of the turbine 10, in the centre thereof, said connection piece being provided for guiding and easier holding of the shaft.

FIG. 3C shows a view from a bottom side of the turbine of the second exemplary embodiment. The turbine wheel 10*a* has longitudinal and transverse ribs 35 arranged in a lattice-like manner, as well as a rib 34 along the circumferential edge 16 for reinforcing and strengthening the turbine wheel 10*a*. As an alternative to the uniform arrangement of the ribs 35 shown here, an irregular arrangement is also possible. By arranging the ribs irregularly in a certain way, the turbine can for example be correctly balanced. The ribs 34 and 35 can also be used to conduct the oil away or to reduce the noise produced.

Figure 4A:
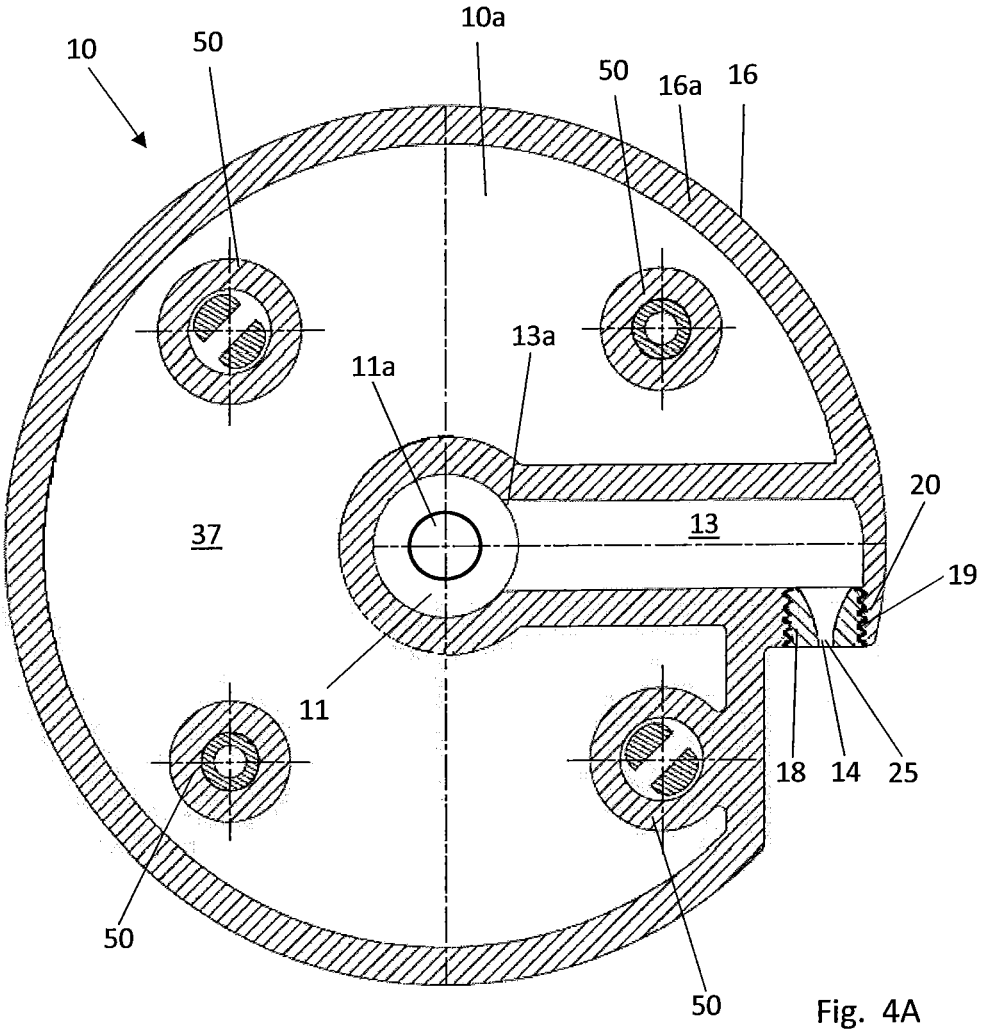
FIG. 4A shows a horizontal section through a turbine according to the invention according to a third exemplary embodiment.
Figure 4B:
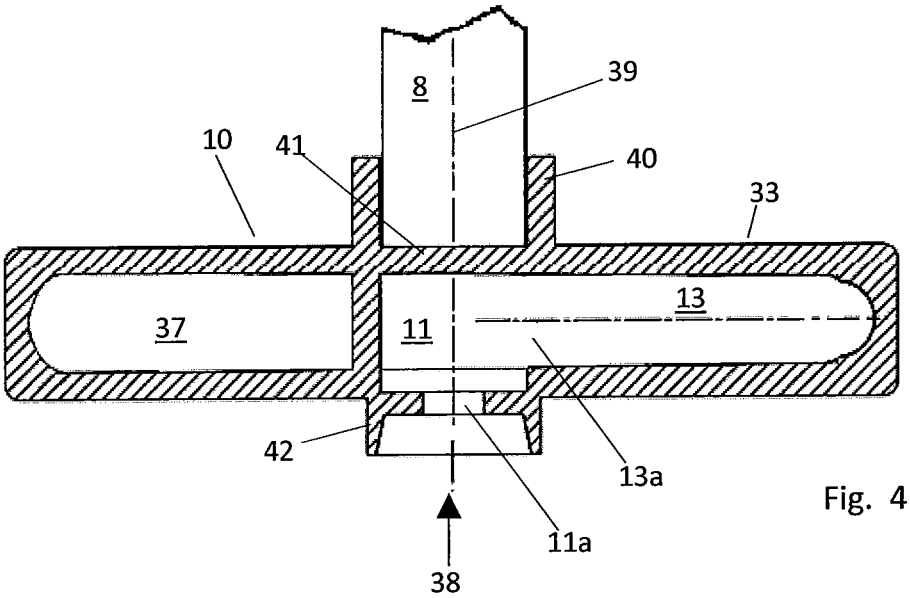
FIG. 4B shows a vertical section through a turbine according to the invention according to the third exemplary embodiment.

FIGS. 4A and 4B show a third exemplary embodiment of a turbine 10 according to the invention, in a horizontal sectional view (4A) and in a vertical sectional view (4B). The horizontal sectional view runs approximately at half the height of the second channel 13. In a manner differing from the exemplary embodiment of FIG. 2, the second channel 13 runs only in a radial direction from the first channel 11 to the circumferential edge 16, in a largely rectilinear manner. At the circumferential edge 16, the outlet 25 is branched off perpendicularly, that is to say in a tangential direction, from the rest of the second channel 13. A metal fluid nozzle 18 is likewise screwed into the outlet 25, the counter-thread 20 being formed directly in the plastic casing 15. The region between the wall 16*a* at the circumferential edge 16 and the wall of the channels 11, 13 is largely configured as a cavity, and the reinforcing ribs, which are necessary for balancing the weight of the turbine wheel 10*a*, have not been shown.

Here, the shaft 8 does not extend through the turbine 10 as in FIG. 1, but rather ends in a connection piece 40 on the top side of the turbine wheel 10*a*. The shaft 8 is thus separated from the first channel 11 by a partition wall 41. The turbine 10 is mounted by way of a connection piece 42 which protrudes on the bottom side. The oil enters the first channel 11 through an opening 11*a* on the bottom side of the turbine wheel 10*a*, said opening being arranged centrally in relation to the connection piece 42.

Figure 5A:
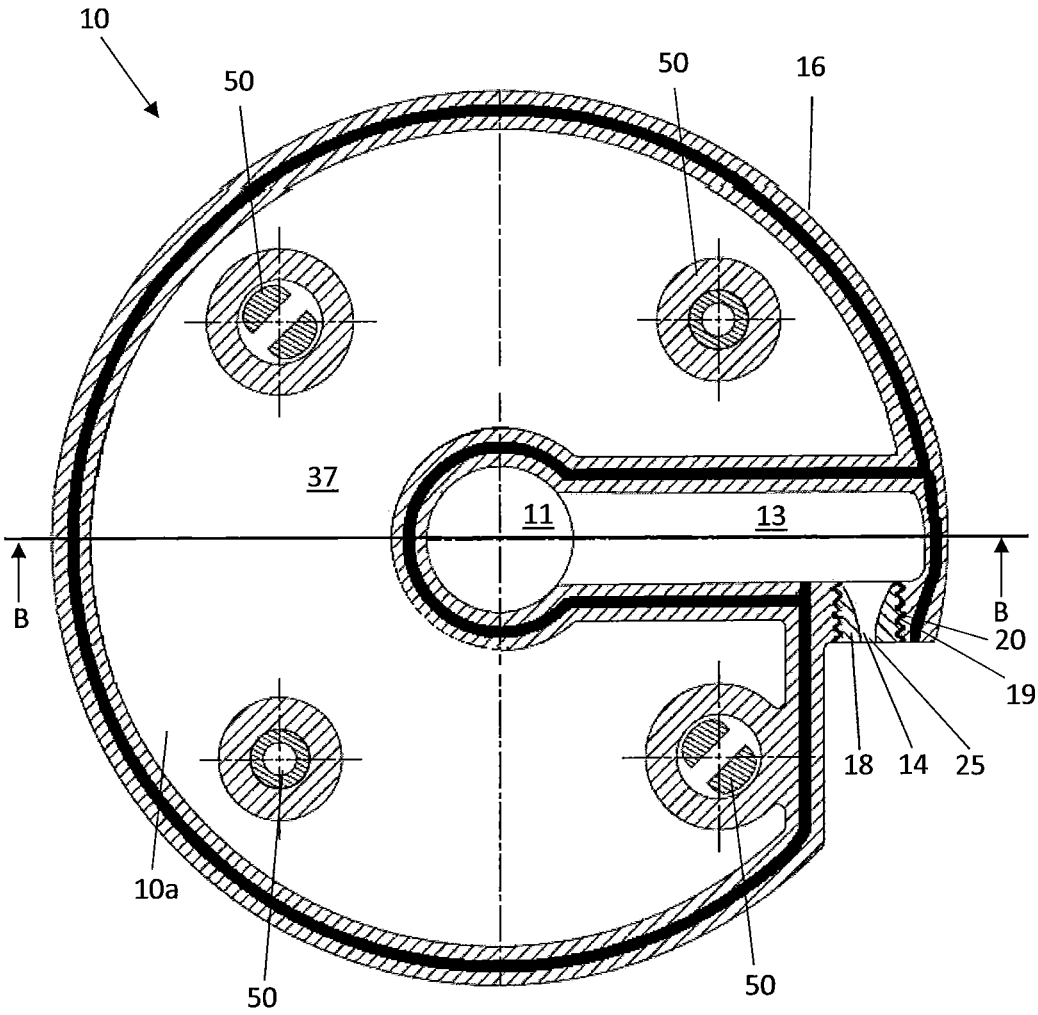
FIG. 5A shows a horizontal section through a turbine according to the invention according to a fourth exemplary embodiment.
Figure 5B:
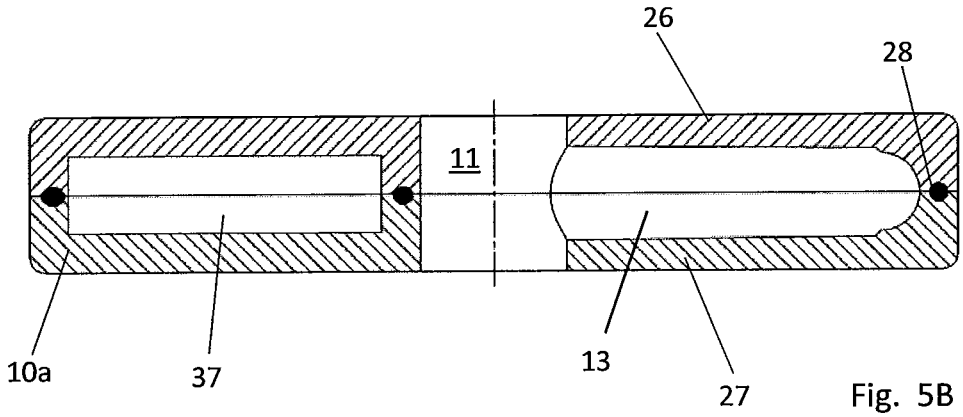
FIG. 5B shows a vertical section through a turbine according to the fourth exemplary embodiment.

FIGS. 5A and 5B show a fourth exemplary embodiment of a turbine 10 according to the invention, in a horizontal sectional view (5A) and in a vertical sectional view (5B). In a manner differing from the third exemplary embodiment, the turbine 10 in this exemplary embodiment is divided horizontally into an upper shell 26 and a lower shell 27. Between the shells, a sealing element 28 is arranged along the circumferential edge 16 and along the walls of the first and second channel 11 and 13. Furthermore, a cavity 37 is arranged in the interior of the turbine wheel 10*a* . Said cavity serves to reduce the overall weight of the turbine 10 and/or to balance the turbine 10. Reinforcing ribs, which bring about the precise balancing, are not shown here.

Figure 6A:
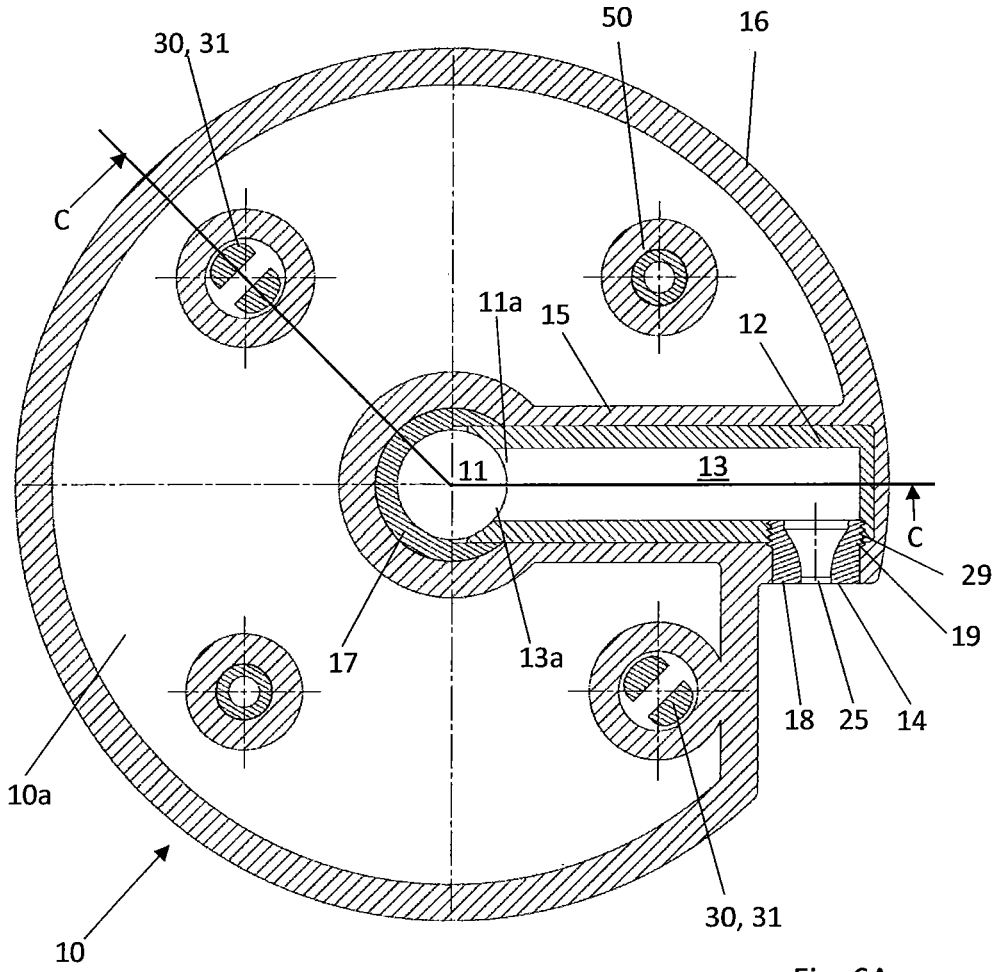
FIG. 6A shows a horizontal section through a turbine according to a fifth exemplary embodiment.
Figure 6B:
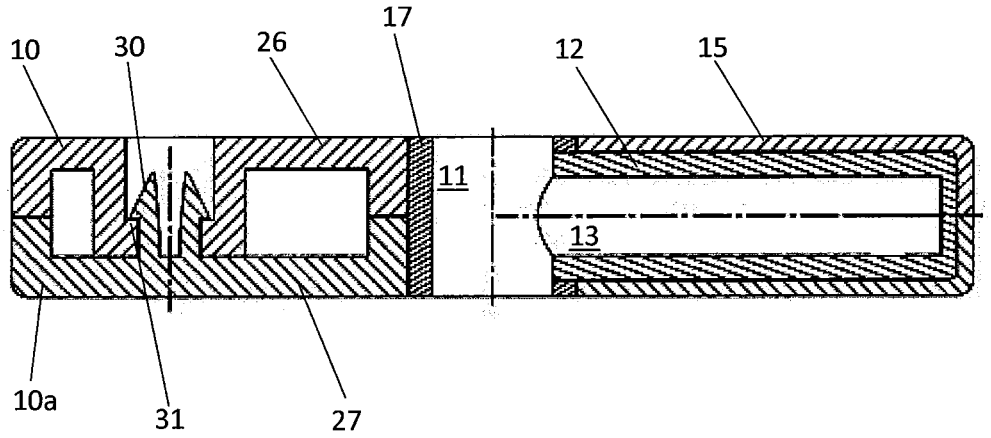
FIG. 6B shows a vertical section through a turbine according to the fifth exemplary embodiment.

FIGS. 6A and 6B show a fifth exemplary embodiment of a turbine 10 according to the invention. FIG. 6A shows a horizontal section through the turbine 10. As in the third and fourth exemplary embodiment, the second channel 13 runs rectilinearly in a radial direction from the first channel 11 to the circumferential edge 16, at which point the outlet 25 is angled in a tangential direction perpendicularly to the rest of the second channel 13. As in the first exemplary embodiment, the first and second channel 11 and 13 have metal reinforcements 12 and 17, wherein the metal reinforcement 12 of the second channel 13 is a metal tube which, in the region of the inlet 13*a*, is inserted into an opening and cutout 11*a* of the metal reinforcement 17. A fluid nozzle 14 is screwed into the outlet 25. In a manner differing from the preceding exemplary embodiments, the counter-thread 29 for the fluid nozzle is formed not in the plastic casing 15 but rather in the metal tube 12.

FIG. 6B shows a vertical section through the turbine 10 along the line C-C. The turbine of the fifth exemplary embodiment is likewise divided into an upper shell 26 and a lower shell 27. The two shells 26, 27 can be connected by means of a latching closure. The latching closure comprises latching protrusions 30 arranged on the lower shell 27 and engagement means 31 arranged on the upper shell 26, behind which the latching protrusions 30 engage when the lower shell 27 and the upper shell 26 are brought together.

Figure 7:
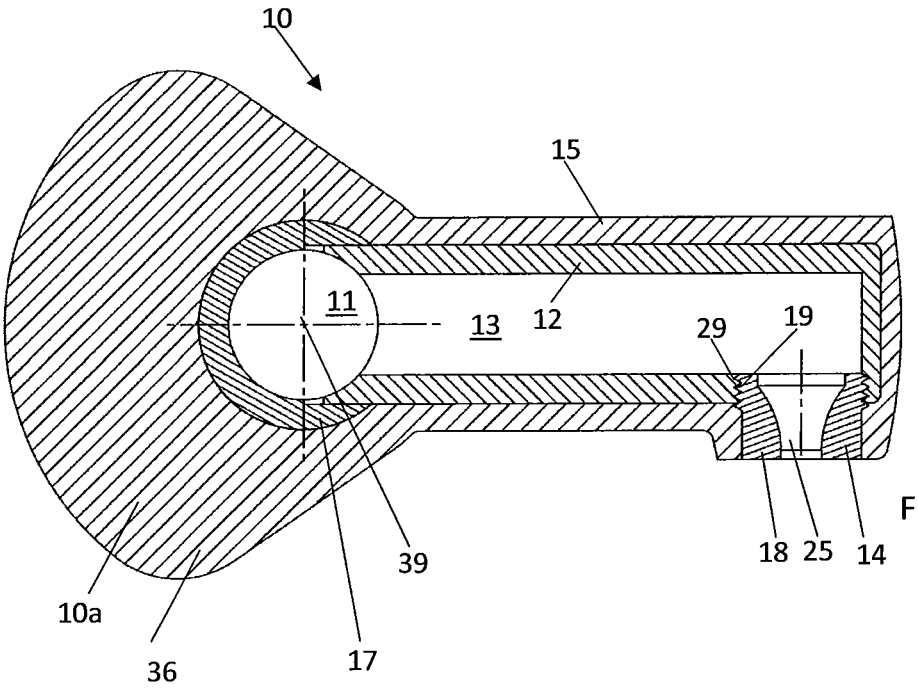
FIG. 7 shows a horizontal section through a turbine according to a sixth exemplary embodiment.

FIG. 7 shows a sixth exemplary embodiment of a turbine 10 according to the invention, in a horizontal sectional view. In contrast to the previous exemplary embodiments, the turbine wheel 10*a* is not rotationally symmetrical about the axis of rotation 39 but rather has a second channel 13 only on one half-side of the turbine 10, said second channel being configured as in the fifth exemplary embodiment. On the half-side of the turbine 10 opposite to the second channel 13, the turbine wheel 10*a* has only a compensating body 36 as a counter-weight to the second channel 13 or for adjusting the imbalance. The first channel 11 is likewise configured as in the fifth exemplary embodiment.

Figure 8A:
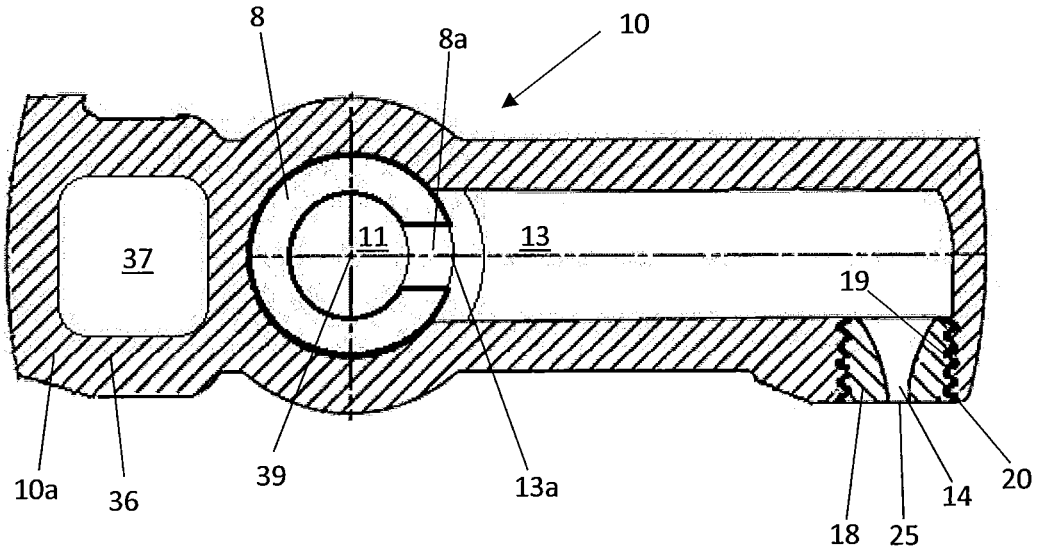
FIG. 8A shows a horizontal section through a turbine according to a seventh exemplary embodiment.
Figure 8B:
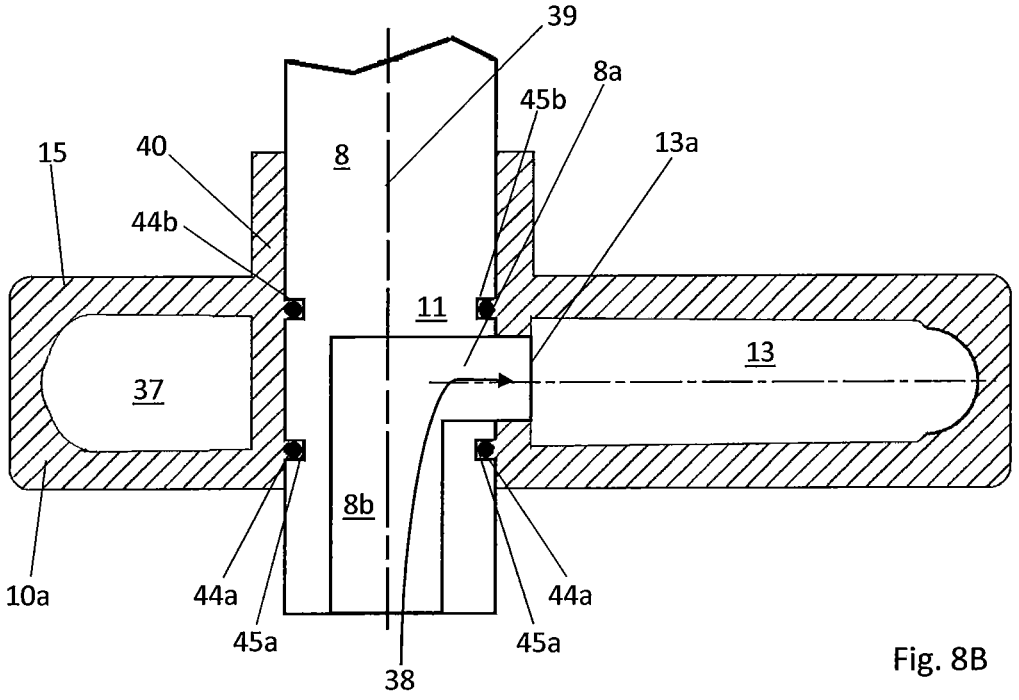
FIG. 8B shows a vertical section through a turbine according to the seventh exemplary embodiment.

FIGS. 8A and 8B show a seventh exemplary embodiment of a turbine 10 according to the invention, in a horizontal sectional view (8A) and in a vertical sectional view (8B). Here, too, the turbine wheel 10*a* is not rotationally symmetrical in relation to the axis of rotation 39, as was already the case in the sixth exemplary embodiment. On the half-side of the turbine opposite to the second channel 13, the turbine wheel 10*a* has only compensating bodies 36, wherein the compensating body 36 here is cut open so that the cavity that exists therein is visible. In addition, the compensating body 36 in FIGS. 8A and 8B is smaller, in terms of its external dimensions, than that in FIG. 7, since here the half-side that includes the second channel 13 has a lower weight and therefore a lower compensating weight is necessary on the opposite side in order to adjust the imbalance. The second channel 13 is configured here as in the second exemplary embodiment, that is to say only with a plastic casing 15 but with no metal reinforcement. Here, the fluid nozzle is formed in a ceramic element 18, which is screwed into the plastic body of the turbine wheel 10*a*.

Here, the shaft 8 is injection-moulded directly into the plastic body 15 or is overmoulded with the plastic body 15 and thus is accommodated in the first channel 11. The shaft 8 has two annularly running grooves 45*a* , 45*b* on its outer surface in the region of the turbine wheel 10*a* , an O-ring 44*a* , 44*b* being accommodated in each of said grooves. In the case of overmoulding, the grooves 45*a* , 45*b* are not only filled but are pressed onto the O-rings so that a sealed connection is achieved between the turbine wheel 10*a* and the shaft. The central bore 8*b* of the shaft is also shown here, through which the engine oil is introduced in the direction 38. The engine oil enters the second channel 13 via the opening 8*a* in the side wall of the shaft.

Figure 9:
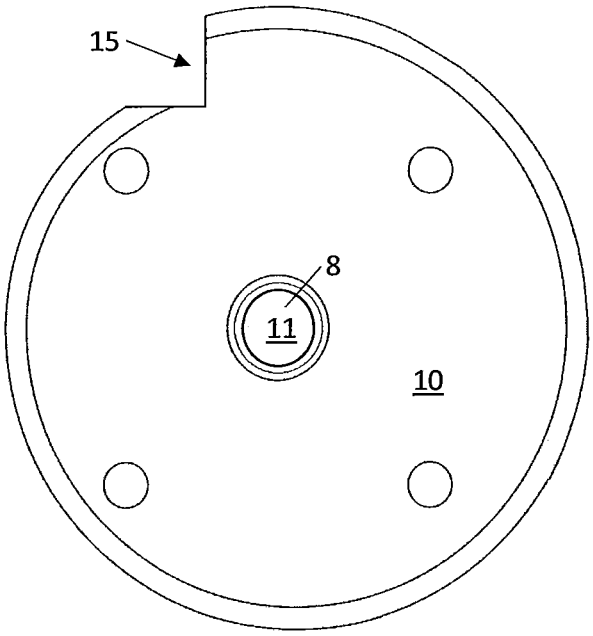
FIG. 9 shows a plan view of a turbine according to an eighth exemplary embodiment.

FIG. 9 shows an eighth exemplary embodiment of a turbine 10 according to the invention, in an axial plan view.

The outer contour of the turbine 10 in this exemplary embodiment differs from the outer contour of the exemplary embodiments of FIGS. 2 to 6. While in the preceding exemplary embodiments a substantially circular outer geometry was selected, apart from the cutout at the outlet of the nozzle 14, here a spiral-shaped outer geometry is used, that is to say that the outer circumferential line of the turbine 10 runs inward in the manner of a spiral. This also results in an off-centre arrangement of the shaft 8 and of the first channel 11.

The invention claimed is:

1. A turbine comprising a turbine wheel, the turbine wheel having a first channel running along an axis of rotation of the turbine wheel, and a second channel, running substantially in a radial direction, for guiding a fluidic drive medium, said second channel having an inlet and an outlet for the fluidic drive medium, wherein the inlet is fluidically connected to the first channel and the outlet is directed substantially in a tangential direction of the turbine wheel, wherein the turbine has a fluid nozzle in the outlet, and wherein a metal and/ or ceramic reinforcement including stiffening ribs is arranged in at least one section of a wall of at least one of the first and second channels wherein the first channel and the second channel, with the exception of the outlet, each extends substantially rectilinearly, and wherein the stiffening ribs of the metal and/or ceramic reinforcement of said at least one of the first channel and second channels, and the fluid nozzle, contain or are made of stainless steel, brass, copper, die-cast zinc, die-cast aluminum, sintered metal and/or at least one technical ceramic.

2. The turbine according to claim 1, wherein the fluid nozzle is formed in one piece with the turbine wheel.

3. The turbine according to claim 2, wherein the fluid nozzle is inserted in the second channel as a separate component in the region of the outlet and contains or is made of a metal and/or a ceramic.

4. The turbine according to claim 1, wherein the first channel is designed to receive a shaft or is formed in an extension of the receptacle for a shaft.

5. The turbine according to claim 1, wherein the entire wail of the first channel and/or of the second channel has a metal reinforcement.

6. The turbine according to the claim 5, wherein the metal reinforcement forms an inner wall of the first channel and/or second channel and/or of the fluid nozzle.

7. The turbine according to claim 6, wherein the metal reinforcement of the first channel has, in a region of connection to the second channel, a cutout in which the metal reinforcement of the second channel is inserted and/or in Which the metal reinforcement of the second channel is welded, soldered or crimped to the metal reinforcement in the first channel.

8. The turbine according to claim 1, wherein the turbine wheel is formed of two half-shells which, in order to form the turbine wheel, are joined together along a plane that is transverse to the axis of rotation of the turbine wheel or transverse to the direction of the outlet.

9. The turbine according to claim 1, wherein an impeller or a sealing element acting as further functional components, is arranged on a top side of the turbine wheel.

10. The turbine according to claim 1, wherein the stiffening ribs are outside of the channels.

11. The turbine according to claim 1, wherein the turbine wheel has a housing, wherein the stiffening ribs as reinforcing structures, are arranged within the housing.

12. The turbine according to claim 1, wherein the turbine wheel, including an upper and/or lower surface of the turbine wheel, and/or a housing thereof are made of or contain plastic, including fibre-reinforced or filler-filled plastic.

13. The turbine according to claim 12, wherein the plastic is or contains polyphenylene, sulphide (PPS), polyetherimide (PEI), polyimide (PI), polyphthalamide (PPA), polyether ether ketone (PEEK), polyamide (PA), polypropylene (PP), polyester resin (UP), vinyl ester resin (VE), epoxy resin (EP), phenol resin (PF), melamine formaldehyde resins (MF), or a combination of the aforementioned materials.

14. The turbine according to claim 13, wherein one or more of the following types of fibre are used as reinforcing fibres: carbon fibres, glass fibres, polyester fibres and/or aramid fibres.

15. The turbine according to claim 1, wherein the turbine wheel and/or a housing thereof can be partially or entirely manufactured by an injection moulding, injection-compression moulding and/or transfer moulding process and/or by pressing.

16. The turbine according to claim 15, wherein the metal and/or ceramic reinforcement is embedded in the turbine wheel.

17. A liquid separator for separating liquid droplets and/or liquid mist, including oil droplets and/or oil mist, out of a gas, including blow-by gases of an internal combustion engine, comprising a rotatably mounted separating element and a drive element for rotatably driving the separating element, wherein the drive element comprises a turbine according to claim 1.

* * * * *